US011295923B2

(12) United States Patent
Meng et al.

(10) Patent No.: US 11,295,923 B2
(45) Date of Patent: Apr. 5, 2022

(54) RECTANGULAR MAGNETRON TUBE CORE

(71) Applicant: University of Electronic Science and Technology of China, Chengdu (CN)

(72) Inventors: Lin Meng, Chengdu (CN); Yong Yin, Chengdu (CN); Bin Wang, Chengdu (CN); Hailong Li, Chengdu (CN); Yu Zhao, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 0 days.

(21) Appl. No.: 17/037,649

(22) Filed: Sep. 29, 2020

(65) Prior Publication Data

US 2021/0110988 A1 Apr. 15, 2021

(30) Foreign Application Priority Data

Oct. 11, 2019 (CN) ..... 201910961937.8

(51) Int. Cl.
*H01J 23/22* (2006.01)
*H01J 25/50* (2006.01)

(52) U.S. Cl.
CPC ..... *H01J 23/22* (2013.01); *H01J 25/50* (2013.01)

(58) Field of Classification Search
CPC .. H01J 23/05; H01J 23/22; H01J 25/00; H01J 25/50; H01J 25/56; H01J 43/12; H01J 2217/10; H01J 1/36; H01J 2223/22; H01J 2225/00; H01J 2225/50; H01J 2225/60
See application file for complete search history.

(56) References Cited

U.S. PATENT DOCUMENTS

2011/0227480 A1* 9/2011 Saitou ..... H01J 23/05 315/39.51

* cited by examiner

*Primary Examiner* — Henry Luong
(74) *Attorney, Agent, or Firm* — Matthias Scholl P.C.; Matthias Scholl

(57) ABSTRACT

A rectangular magnetron tube core including: an anode component having two openings respectively formed in two end portions thereof; a cathode component disposed on the center axis of an anode barrel; an input component and an output component respectively disposed on the two openings formed outside the two end portions of the anode barrel. The anode component includes: the anode barrel, a plurality of anode vanes, two strapping rings, an A-side pole shoe and a K-side pole shoe. The anode vanes are uniformly disposed on the inner side wall of the anode barrel. The tips of the anode vanes leave a tubular space at the center axis of the anode barrel, and the two strapping rings are both ring-structure erected on both sides of the anode vanes. The structure of the A-side pole shoe is completely symmetrical with that of the K-side pole shoe.

4 Claims, 4 Drawing Sheets

RECTANGULAR MAGNETRON TUBE CORE

CROSS-REFERENCE TO RELATED APPLICATIONS

Pursuant to 35 U.S.C. § 119 and the Paris Convention Treaty, this application claims foreign priority to Chinese Patent Application No. 201910961937.8 filed Oct. 11, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a magnetron tube core.

A conventional magnetron tube core comprises an anode component, a cathode component, an input component, and an output component. The anode component comprises an anode barrel, a plurality of anode vane, a plurality of strapping rings, an A-side pole shoe and a K-side pole shoe. The shape of the anode barrel is cylindrical and the size thereof is bulky. The anode vanes are disposed in the periphery of the anode barrel, which is not conducive to the miniaturization of the existing magnetron.

SUMMARY

It is one object of the disclosure to provide a rectangular magnetron tube core, the output power of which is equivalent to that of the magnetrons operating at a normal voltage. The tube size is significantly smaller than the existing core after changing the anode shape to be rectangular.

The disclosure provides a rectangular magnetron tube core comprising: an anode component having two openings respectively formed in two end portions thereof; a cathode component disposed on the center axis of an anode barrel; an input component and an output component respectively disposed on the two openings formed outside the two end portions of the anode barrel.

The anode component comprises: the anode barrel, a plurality of anode vanes, two strapping rings, an A-side pole shoe and a K-side pole shoe; the anode vanes are uniformly disposed on the inner side wall of the anode barrel; tips of the anode vanes leave a tubular space at the center axis of the anode barrel, and the two strapping rings are both ring-structure erected on both sides of the anode vanes; structure of the A-side pole shoe is completely symmetrical with that of the K-side pole shoe; the structures of the A-side pole shoe and the K-side pole shoe are funnel-shaped; bottom of the A-side pole shoe and the K-side pole shoe are circular and the bottom of the center has an opening; the diameter of the opening is the same as the diameter of the tubular space of the anode barrel; the A-side pole shoe is close to the output component; a plate surface of the A-side pole shoe is connected to a port on the output component, and the bottom of the A-side pole shoe is located in the anode barrel; the K-side pole shoe is close to the input component; plate surface of the K-side pole shoe is connected to a port on the input component, and the bottom of the K-side pole shoe is located inside the anode barrel.

The cathode component comprises: a filament; two end caps, a center lead, a side lead; the two end caps comprise an upper end cap and a lower end cap; the side lead, the upper end cap, the filament, and the lower end cap are connected in sequence; one side of the center lead is inserted into the center of the input component, another side of the center lead connected to the lower end cap through a hole formed in a central portion of the upper end cap and an inner space of the filament; the center lead is not in contact with the center of the filament and the upper end cap; the filament is disposed in the central space of the anode barrel through a hole formed in the K-side pole shoe.

The output component comprises: an antenna, an insulation ring, and an antenna cap; the antenna is extended from the insulation ring and the antenna cap and is connected to only one of the vanes in the anode barrel through the A-side pole shoe; the antenna is not in contact with A-side pole shoe.

The anode barrel comprises four rectangular sides, and the anode barrel has a square cross-section, the number of the vanes is eight, which are disposed radially on diagonal planes, vertical plane and horizontal plane fixedly mounted on an inner wall surface of the anode barrel; a vane connected to the antenna is a diagonal vane inside the anode barrel; the center lead, the side lead and the antenna are fixed on the same plane.

In addition, the strapping rings comprise an inner uniform pressure ring and an outer uniform pressure ring.

Above benefit of the technical scheme is making mode separation better so as to avoid interference of the mode adjacent to π-mode that can interfere the normal operation of π-mode.

In addition, the length of the four rectangular sides is 32 mm, and the distance between the two ends of the anode barrel is 30 mm.

In addition, the thickness of the vanes is 2 mm, and the longitudinal length of the vanes is 8.8 mm; the radius of the two openings formed inside the A-side pole shoe and the K-side pole shoe is 4.4 mm.

Above benefits of the technical scheme are: the π-mode of a magnetron operates at 2.458 GHz. A rectangular-shaped anode structure is used instead of the conventional cylindrical anode structure to reduce the size of the magnetron. The cylindrical anode barrel with diameter of 40 mm is replaced by the rectangular anode barrel with a side length of 32 mm, and the number of vanes changes from 10 to 8. The magnetron works at frequency of 2.458 GHz and in the voltage range of 3-5 kV. Power is 700-1200 W, which is equal to power of the conventional magnetron.

The disclosure proposes a magnetron structure with a rectangular-shaped anode resonant cavity. This cavity is simple and size of the rectangular magnetron is reduced; the anode component is highly symmetrical, so that the electromagnetic field in the anode component is as symmetrical as possible, which is convenient for adjusting the operating frequency; the size of the rectangular magnetron tube core of the invention is small; magnetrons using the present rectangular magnetron tube core operates at the normal voltage, and the power of the tube core is close to the existing magnetrons but the size of the rectangular tube core is smaller.

Figure 1:
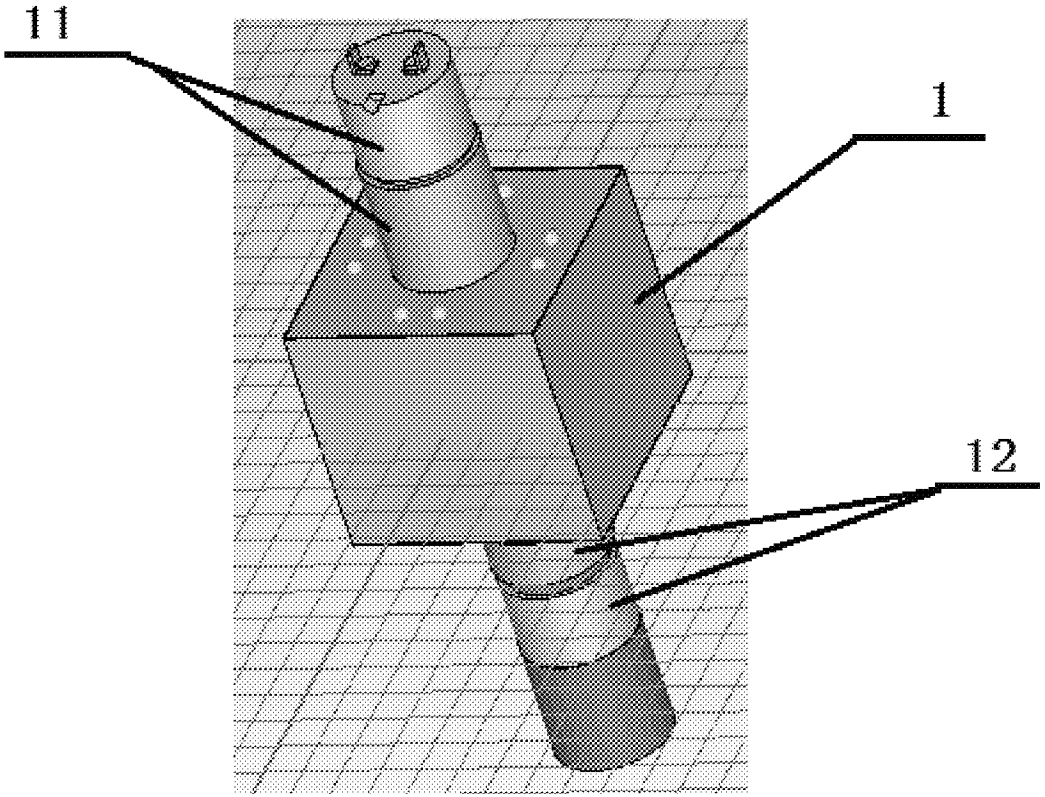
FIG. 1 is an external view of a rectangular magnetron tube core according to an embodiment.

In the drawings, the following number references are used: 1. Anode barrel; 2. Vane; 3. Strapping ring; 4. Output antenna; 5. A-side pole shoe; 6. K-side pole shoe; 7. Filament; 8. End cap; 9. Center lead; 10. Side lead; 11. Input component; and 12. Output component.

DESCRIPTION OF THE PREFERRED EMBODIMENTS

To further illustrate, embodiments detailing a rectangular magnetron tube core are described below. It should be noted that the following embodiments are intended to describe and not to limit the disclosure.

Figure 2:
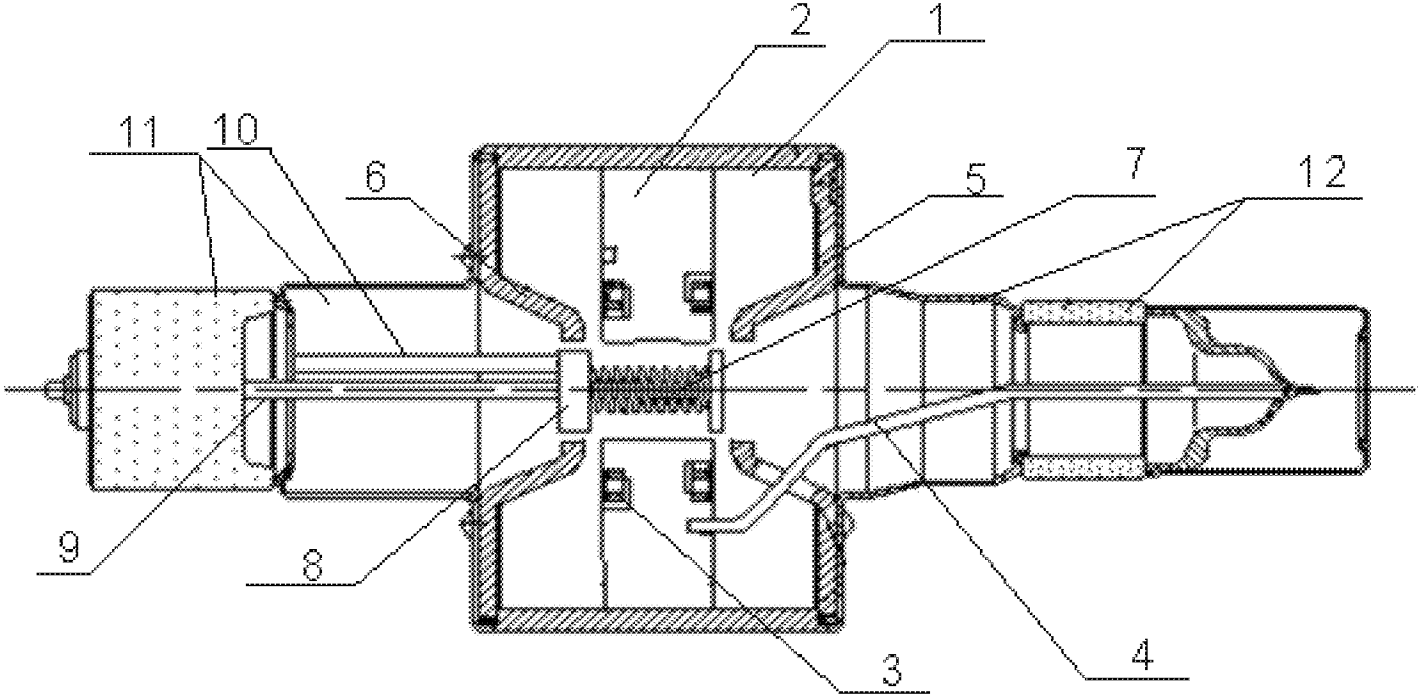
FIG. 2 is a longitudinal section view of a rectangular magnetron tube core according to an embodiment.

Referring to FIG. 1 to FIG. 2, a rectangular magnetron tube core comprises: an anode component, a cathode component, an input component 11 and an output component 12; the input component 11 and the output component 12 are respectively disposed on the two openings formed outside two end portions of the anode barrel. The cathode component disposed on the center axis of the anode barrel 1 and connected to the input component 11.

In certain embodiments, the anode component comprises: an anode barrel 1, a plurality of vanes 2, two strapping rings 3, an A-side pole shoe 5 and a K-side pole shoe 6; each vane 2 is uniformly disposed on the inner side wall of the anode barrel. Tips of each vane 2 leave a tubular space at the center axis of the anode barrel 1, and the two strapping rings 3 are both ring-structure erected on both sides of the plurality of vanes 2. Structure of the A-side pole shoe 5 are completely symmetrical with that of the K-side pole shoe 6. The structure is funnel-shaped. Bottom of the structure is circular and the bottom of the center has an opening. The diameter of the opening is the same as the diameter of the tubular space of the anode barrel 1. The A-side pole shoe 5 is close to the output component 12. The plate surface of the A-side pole shoe 5 is connected to a port on the output component 12, and the bottom of the A-side pole shoe 5 is located in the anode barrel 1. The K-side pole shoe 6 is close to the input component 11. Plate surface of the K-side pole shoe 6 is connected to a port on the input component 11, and the bottom of the K-side pole shoe 6 is located in the anode barrel 1.

In certain embodiments, the cathode component comprises: a filament 7; two end caps 8, a center lead 9, a side lead 10. The end caps 8 comprise upper end cap and a lower end cap; the side lead 10, the upper end cap, the filament 7, and lower end cap are connected in sequence; one side of the center lead 10 disposed so as to be inserted into the center of the input component 11, another side of the center lead 10 connected to the lower end cap through a hole formed in a central portion of the upper end cap and an inner space of the filament 7. The center lead 9 is not in contact with the center of the filament 7 and the upper end cap. The filament 7 disposed in the central space of the anode barrel 1 through a hole formed in the K-side pole shoe 6.

According to the rectangular magnetron tube core of one embodiment, the output component comprises: an antenna 4, an insulation ring, an antenna cap, the antenna 4 extended from the insulation ring and the antenna cap then the antenna 4 connected to only one of the vanes 2 in the anode barrel 1 through the A-side pole shoe 5; the antenna 4 is not in contact with A-side pole shoe 5.

Figure 3:
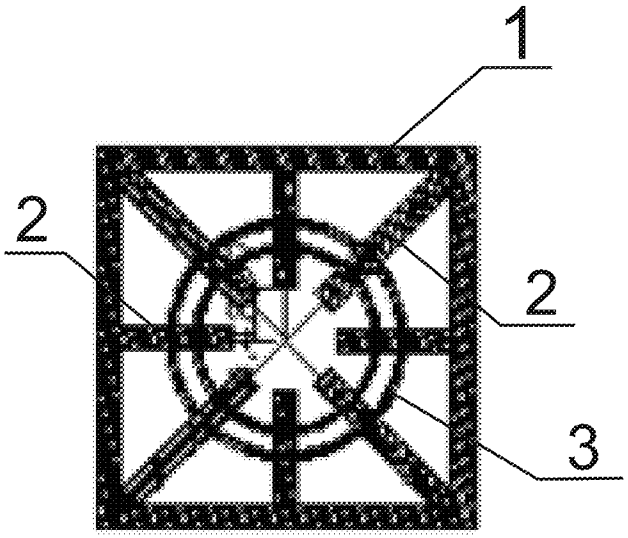
FIG. 3 is a cross-sectional view of a rectangular magnetron tube core to show relative position of an anode barrel, vanes, and two strapping rings.

FIG. 3 shows the number of the vanes 2 is eight, disposed radially on the diagonal planes, the vertical plane and the horizontal plane fixedly mounted on the inner wall surface of the anode barrel 1. The vane 2 connected to the antenna is located on the diagonal surface inside the anode barrel 1 so as to the anode component is as symmetrical as possible, which is convenient for adjusting the operating frequency. The strapping rings comprise an inner uniform pressure ring and an outer uniform pressure ring making mode separation better so as to avoid interference of the mode adjacent to π-mode that can interfere the normal operation of π-mode.

Figure 4:
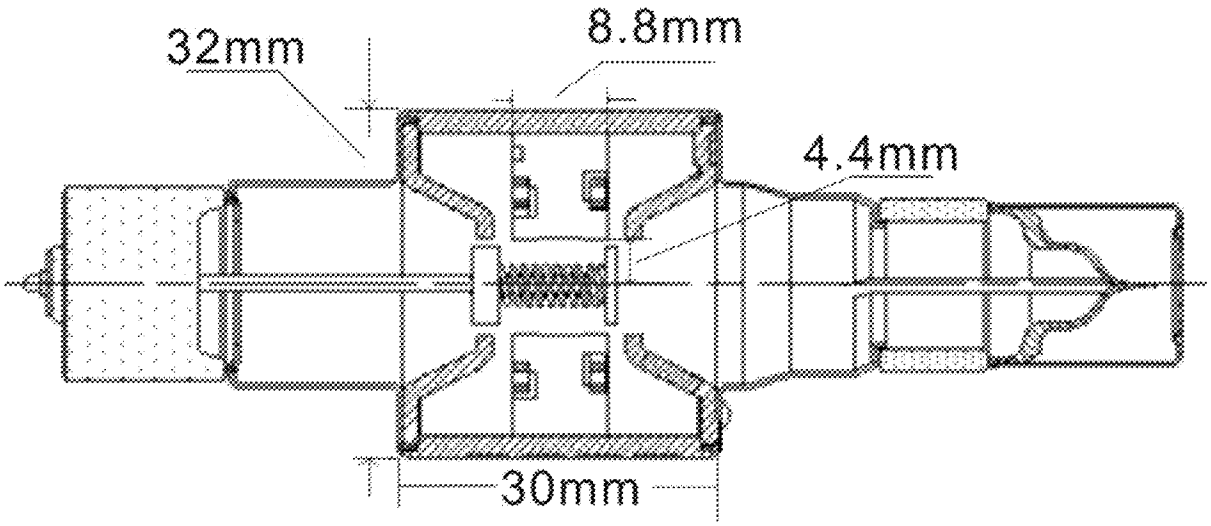
FIG. 4 is a dimensional drawing of a longitudinal section view of a rectangular magnetron tube core according to an embodiment.

FIG. 4 shows according to embodiment of the present of the present utility model, the length of the anode barrel 1 is 30 mm, the cross section of the anode barrel 1 is square-shaped, outer side length of the square is 32 mm, and the inner side length of the square is 30 mm; the thickness of the vanes 2 is 2 mm, and height of the vanes along the central axis of the anode barrel 1 is 8.8 mm, thickness of the A-side pole shoe 5 and the K-side pole shoe 6 is 1.8 mm, depth of the both pole shoes is 7.0 mm, radius of both large opening in the A-side pole shoes and K-side pole shoe is 9.5 mm, radius of both small opening in the A-side pole shoes and K-side pole shoe is 6.5 mm, the radius of the center hole in the small opening is 4.4 mm, the diameter of the center lead 9 is 1.2 mm, the diameter of the side lead 10 is 1.2 mm, the thickness and diameter of the upper end cap are 2.2 mm and 4.35 mm, respectively, the thickness and diameter of the lower end cap are 1.0 mm and 4.35 mm, respectively. The length of the filament 7 is 9.0 mm, the outer diameter of the filament 7 is 3.8 mm and the inner diameter of the filament 7 is 1.8 mm.

The π-mode of a magnetron operates at 2.458 GHz. A rectangular-shaped anode structure is used instead of the conventional cylindrical anode structure to reduce the size of the magnetron. The cylindrical anode barrel with diameter of 40 mm is replaced by the rectangular anode barrel with a side length of 32 mm, and the number of vanes changes from 10 to 8. The magnetron works at frequency of 2.458 GHz and in the voltage range of 3-5 kV. Power is 700-1200 W, which is equal to power of the conventional magnetron.

A direct current high voltage flows in from the center lead 9, through the cathode filament 7 and then flows out along the side lead 10; when the cathode filament 7 is heat, and the direct current high voltage is applied to and between the anode vane and cathode structure, electrons are drawn out from the cathode filament 7 and thus they fly out toward the anode vane 2. At the then time, the magnetic field due to the two magnets (not shown) concentrates in a gap existing between the output side pole piece 12 and input side pole piece 11, and it acts on the action space in a direction perpendicular to a direction where the cathode filament 7 and anode barrel 1 are opposed to each other. As a result of this, electrons flown out from the cathode filament 7 are rotated and moved in a spiral by a force which is generated by the magnetic field due to the magnets (not shown), and the electrons finally arrive at the anode vane 2. Energy generated due to the then time electrons movements is applied to the cavity resonator to contribute toward the oscillation of the magnetron, and then energy outputs through the antenna 4 connected to vane 2 and the output component.

The thickness of the vanes is 2 mm, and longitudinal length of the vanes is 8.8 mm; radius of the two openings formed inside the A-side pole shoe and the K-side pole shoe is 4.4 mm. The rectangular magnetron tube core operates in continuous wave, operating frequency of the magnetron is 2.458 GHz, working voltage is 4.1 kV, working mode is π-mode, and power of the magnetron is about 800 W, efficiency is 70% thereof.

In addition, in terms of actual manufacturing, the anode barrel 1 can be manufactured by polishing a metal plate, which is more material-saving and more convenient than the current method of hollowing out solid metal. The use of the rectangular magnetron tube core just caters to the trend of miniaturization, and has broad application prospects and production value. It is worth mentioning that for the case where the anode barrel has other regular polygonal cross-sections, the magnetron can still be designed with this similar structure. For example, when the cross-section is regular pentagon and regular hexagon, the number of vanes is 10 and 12 respectively.

It will be obvious to those skilled in the art that changes and modifications may be made, and therefore, the aim in the appended claims is to cover all such changes and modifications.

What is claimed is:

1. A rectangular magnetron tube core, comprising: an anode component having two openings respectively formed in two end portions thereof; a cathode component disposed on a center axis of an anode barrel; an input component and an output component respectively disposed on two openings formed outside the two end portions of the anode barrel;

wherein:

the anode component comprises: the anode barrel, a plurality of anode vanes, two strapping rings, an A-side pole shoe and a K-side pole shoe; the plurality of anode vanes are uniformly disposed on inner side wall of the anode barrel; tips of plurality of the anode vanes leave a tubular space at the center axis of the anode barrel, and the two strapping rings are both ring-structure erected on both sides of the plurality of anode vanes; a structure of the A-side pole shoe is symmetrical with that of the K-side pole shoe; the A-side pole shoe and the K-side pole shoe are funnel-shaped; bottoms of the A-side pole shoe and the K-side pole shoe are circular and a bottom of a center has an opening; a diameter of the opening is the same as a diameter of the tubular space of the anode barrel; the A-side pole shoe is close to the output component; a plate surface of the A-side pole shoe is connected to a port on the output component, and the bottom of the A-side pole shoe is located in the anode barrel; the K-side pole shoe is close the input component; a plate surface of the K-side pole shoe is connected to a port on the input component, and the bottom of the K-side pole shoe is located inside the anode barrel;

the cathode component comprises: a filament; two end caps, a center lead, a side lead; the two end caps comprise an upper end cap and a lower end cap; the side lead, the upper end cap, the filament, and the lower end cap are connected in sequence; one side of the center lead is inserted into a center of the input component, another side of the center lead connected to the lower end cap through a hole formed in a central portion of the upper end cap and an inner space of the filament; the center lead is not in contact with center of the filament and the upper end cap; the filament is disposed in central space of the anode barrel through a hole formed in the K-side pole shoe;

the output component comprises: an antenna, an insulation ring, and an antenna cap; the antenna is extended from the insulation ring and the antenna cap and is connected to only one of the plurality of anode vanes in the anode barrel through the A-side pole shoe; the antenna is not in contact with the A-side pole shoe; and the anode barrel comprises four rectangular sides, and the anode barrel has a square cross-section, the number of the plurality of anode vanes is eight, which are disposed radially on diagonal planes, vertical plane and horizontal plane fixedly mounted on an inner wall surface of the anode barrel; a vane connected to the antenna is a diagonal vane inside the anode barrel; the center lead, the side lead and the antenna are fixed on same plane.

2. The rectangular magnetron tube core of claim 1, wherein two strapping rings comprise an inner uniform pressure ring and an outer uniform pressure ring.

3. The rectangular magnetron tube core of claim 1, wherein a length of the four rectangular sides is 32 mm, and a distance between two ends of the anode barrel is 30 mm.

4. The rectangular magnetron tube core of claim 1, wherein a thickness of the vanes is 2 mm, and longitudinal length of the plurality of anode vanes is 8.8 mm; a radius of the two openings formed inside the A-side pole shoe and the K-side pole shoe is 4.4 mm.

* * * * *